United States Patent [19]

Becker

[11] 4,120,120

[45] Oct. 17, 1978

[54] LIFTING ARRANGEMENT FOR A WINDOW OF A VEHICLE AND THE LIKE

[75] Inventor: Herbert Becker, Coburg-Neuses, Germany

[73] Assignee: Metallwerk Max Brose GmbH & Co., Coburg, Germany

[21] Appl. No.: 854,139

[22] Filed: Nov. 23, 1977

[30] Foreign Application Priority Data

Dec. 3, 1976 [DE] Fed. Rep. of Germany ..... 2654902

[51] Int. Cl.[2] ..... E05F 11/14

[52] U.S. Cl. ..... 49/351

[58] Field of Search ..... 49/351, 349, 350

[56] References Cited

U.S. PATENT DOCUMENTS

| | | | |
|---|---|---|---|
| 2,772,901 | 12/1956 | Roethel | 49/350 X |
| 2,850,333 | 9/1958 | Hamman | 49/351 X |
| 3,020,040 | 2/1962 | King et al. | 49/351 X |
| 3,897,652 | 8/1975 | Hess | 49/351 |

*Primary Examiner*—Philip C. Kannan
*Attorney, Agent, or Firm*—Hans Berman

[57] ABSTRACT

A window is mounted on supporting structure of a motorcar body on a carrier for limited vertical movement. A motion-transmitting linkage connecting the carrier to a lifting drive includes a link which is movably secured to the carrier and the supporting structure. One of the securing devices for the link includes a forked guide channel having the shape of a tuning fork and bounding a keyhole-shaped guide slot. A guide pin has a shank slidably received in the slot and two enlarged heads outside the slot on respective ends of the shank. The width of the enlarged slot part is sufficient to pass one of the heads while the remainder of the slot is narrower than the corresponding dimensions of both heads for securing the pin against transverse movement out of the narrow slot part.

8 Claims, 4 Drawing Figures

LIFTING ARRANGEMENT FOR A WINDOW OF A VEHICLE AND THE LIKE

The invention relates to lifting mechanisms for windows of automotive vehicles and the like, and particularly to an improved linkage between the window drive and a carrier for the window.

A movable window of an automotive vehicle is generally mounted on a carrier in a hollow space in a relatively thin body wall of the vehicle. Access to the space is limited. The window is raised and lowered by a rotary manual or electrical drive element at least partly mounted in the hollow space. Its rotary motion is converted to the translatory motion of the window by the motion-transmitting linkage connecting the drive element to the carrier.

Such a linkage frequently includes an arm or link which is movably fastened to the supporting structure and to the window carrier by securing devices of which one includes a guide channel and a guide pin longitudinally guided in the channel. In the assembled condition of the device, two enlarged heads of the guide pin outside the guide channel prevent transverse movement of the pin out of the channel, but at least one of the heads in known window lifting arrangements must be attached to the shank of the pin after the pin has been inserted in the channel. The channel is often located in a portion of the hollow wall space which cannot be seen by a mechanic attaching the head to the shank of the pin, making this relatively simple operation inconvenient and potentially hazardous. Sheet metal bounding the cavity may have sharp edges, not visible to the mechanic and capable of injuring his hands.

It is a primary object of this invention to provide a window lifting arrangement of the basically known type described above which permits the guide pin to be introduced into the hollow space of the body wall in the fully assembled condition, thereby making it unnecessary for an assembling mechanic to risk injury to his hands, and generally facilitating the installation of a linkage between the window lifting drive and a window carrier.

With this object and others in view, as will hereinafter become apparent, the invention provides a securing device which comprises a forked guide channel including two branch portions elongated in a common direction and a bight portion connecting respective, longitudinally terminal parts of the branch portions. The branch portions transversely bound an elongated guide slot therebetween, and the bight portion bounds the slot in one longitudinal direction. The slot is approximately keyhole-shaped and has an enlarged, longitudinally terminal first part and an elongated second part narrower than the first part. A guide pin has a shank portion received in the slot for longitudinal movement and two enlarged head portions outside the slot on respective ends of the shank portion. The width of the first slot part is sufficient to pass one of the head portions, while the width of the second part is smaller than the corresponding dimension of either head portion for securing the pin against transverse movement out of the second slot part.

Other features, additional objects, and many of the attendant advantages of this invention will readily be appreciated as the same becomes better understood by reference to the following detailed description of a preferred embodiment when considered in connection with the appended drawing in which.

Figure 1:
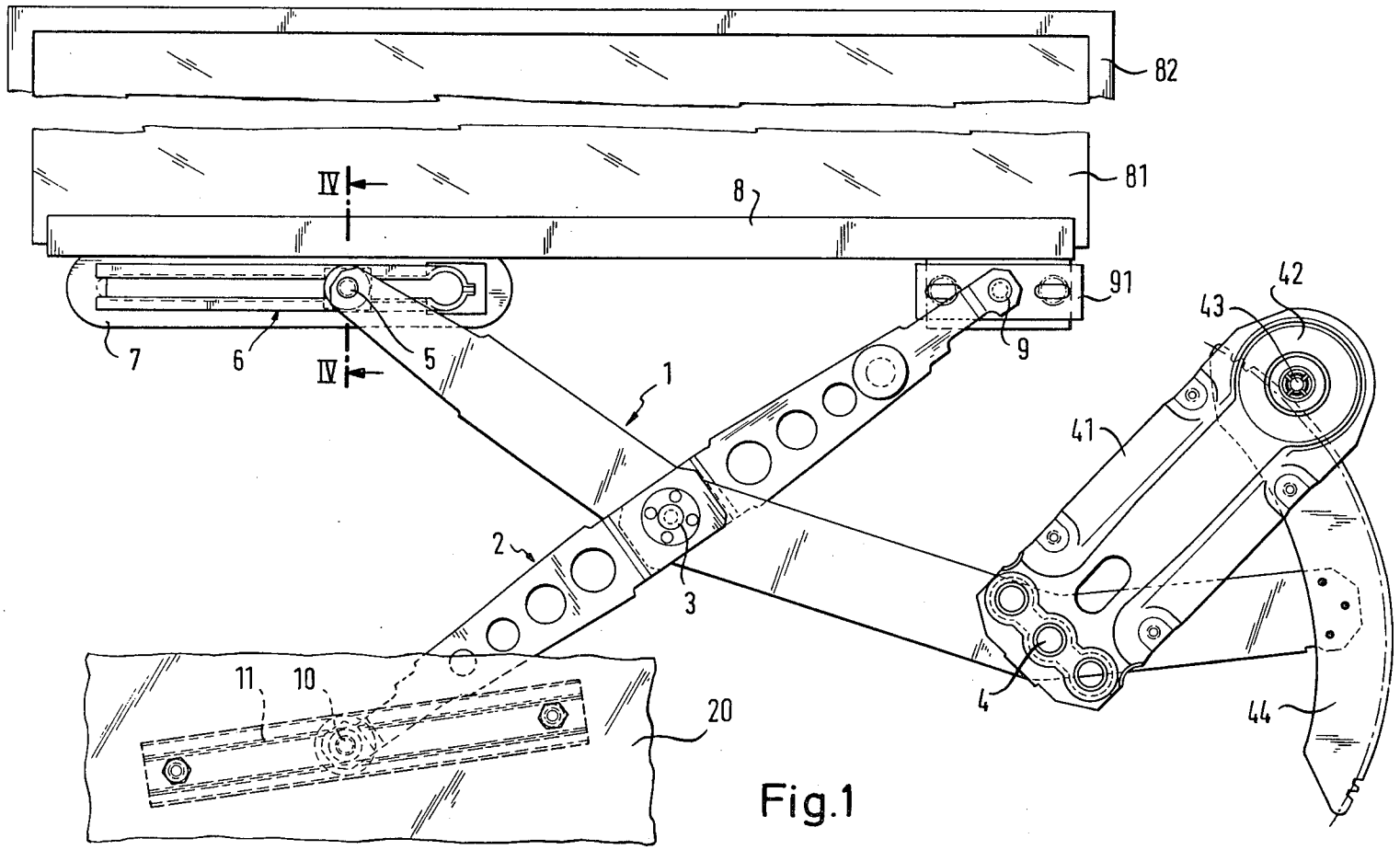
FIG. 1 shows a windowed door of an automotive vehicle in fragmentary side elevation.

Referring now to the drawing in detail, and initially to FIG. 1, there is shown only as much of the door of an otherwise conventional automotive vehicle as is necessary for an understanding of the window lifting mechanism with which this invention is more specifically concerned.

The mechanism includes two sheet metal bars or links 1,2 whose longitudinally central portions are secured to each other by a pivot pin 3. One arm or end portion of the link 1 is pivotally mounted on a shaft 4 on a reinforcing bracket 41 on one of the sheet metal walls 20 of the door bounding the door cavity in which the lifting mechanism is installed. The bracket 41 also carries a remotely controlled, reversible electric motor 42 driving a pinion 43 which meshes with a gear segment 44 on the link 1 for pivoting the link 1 on the shaft 4 when the motor 42 is energized. A guide pin 5 on the other arm of the link 1 is slidably received in a guide channel 6 fixedly mounted on a sheet metal bracket 7 which depends from a carrier channel 8. The lower edge of a window pane 81 is received in the channel 8, and the pane is vertically guided in a frame 82 which is a fixed element of the supporting door and prevents upward movement of the pane 81 beyond the illustrated position.

Another fixed bracket 91 on the carrier channel 8 is provided with a stub shaft 9 on which one arm of the link 2 is pivotally mounted. The other arm of the link 2 is secured to the supporting door structure by a guide channel 11 fixedly fastened to a sheet metal wall 20 of the door and engaging a guide pin 10 on the link 2.

The apparatus described so far is basically conventional and operates in a known manner. When the motor 42 pivots the link 1 counter-clockwise, as viewed in FIG. 1, the window is lowered in the frame 82 toward the hollow space in the door below the window opening. The guide pins 5,11 slide in the slots of the associated guide channels 6,11 during the lowering of the carrier channel 8 and of the window pane 81 mounted therein. When the motor 42 is reversed, the window pane 81 is returned toward the illustrated position.

Figure 2:
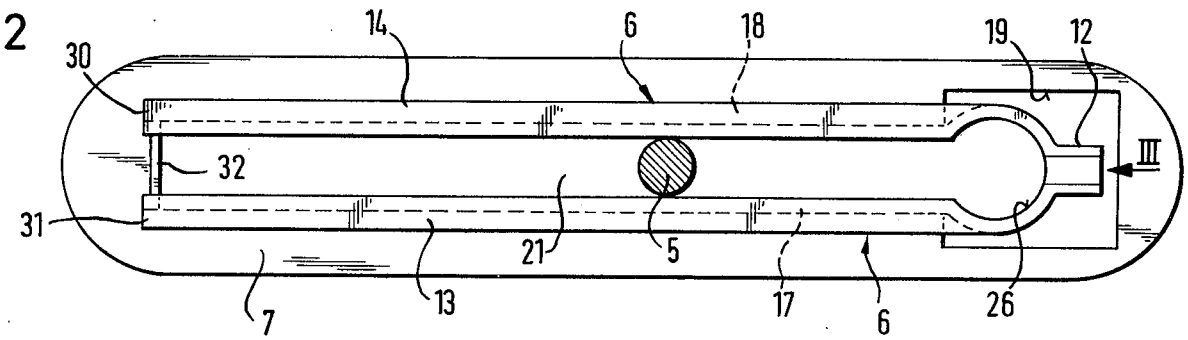
FIG. 2 illustrates elements of the window lifting mechanism in the door of FIG. 1 on a larger scale, and partly in side-elevational section.
Figure 4:
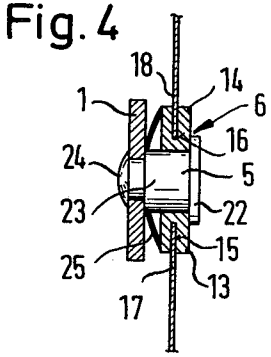
FIG. 4 shows a portion of the window lifting mechanism of FIG. 1 in enlarged section on the line IV—IV of FIG. 1.
Figure 3:
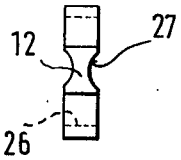
FIG. 3 shows a portion of the device of FIG. 2 as viewed in the direction of the arrow III.

The guide channel 6, the guide pin 5 and associated elements of the window lifting mechanism are seen in greater detail in FIGS. 2 to 4. The channel 6 has the approximate shape of a tuning fork. A bight or stem portion 12 of the channel 6 connects respective longitudinally terminal parts of two elongated branches 13,14 which are straight and parallel over most of their length. They diverge adjacent the bight portion 12 to bound therebetween a circularly enlarged, longitudinally terminal part 26 of a keyhole-shaped slot, the main part 21 of which is narrower than the part 26 and extends between the straight and parallel parts of the branches 13,14.

Longitudinal grooves 15,16 in the branches 13,14 are open in respective opposite directions away from the slot part 21. An opening 19 in the bracket 7 is partly bounded by sheet metal edges 17,18 of the bracket which are received in the grooves 15,16 and thereby fixedly fasten the guide channel 6 to the carrier channel 8. One end of the opening 19 is wide enough to permit the free ends 30,31 of the branches 13,14 to be inserted through the opening for engagement by the somewhat flexible edges 17,18, whereupon the guide channel 6 may be slid along the edges 17,18 until the free ends 30,31 reach the longitudinal end of the opening 19. A lug 32 of the bracket 7, bent perpendicularly out of the plane of FIG. 2, is received as a spacer between the free ends 30,31 of the guide channel 6.

The guide pin 5 has a cylindrical shank 23 whose diameter is slightly smaller than the width of the slot part 21 to permit longitudinal movement of the pin 5 in the slot with a clearance too small to permit illustration on the scale of the drawing. An integral head 22 on the shank 23, best seen in FIG. 4, is a circular disk whose diameter is greater than the width of the slot part 21. An integral rivet 24 on the other axial end of the shank 23 pivotally secures the link 1 to the pin 5. A resilient washer 25 on the shank 5 is axially interposed between the link 1 and outer faces of the branches 13,14 to hold the pin 5 in a fixed axial position on the slot part 21 and to avoid a source of noise in the window lifting mechanism.

The diameter of the slot part 26 is somewhat greater than that of the head 22. The guide pin 5, therefore, may be installed in the channel 6 by inserting the head 22 into the slot part 26 until the larger washer 25 abuttingly engages the outer faces of the branches 13,14. The washer may be compressed during further axial movement of the pin 5 through the slot part 26 until the head 22 clears the branches 13,14, whereupon the shank 23 may be moved into the narrower slot part 21. The insertion of the pin 5 into the guide channel 6 is facilitated by beveled faces 27 on the branches 13,14 in the slot part 21 adjacent the slot part 26. During normal operation of the window lifting mechanism, the pin 5 is prevented from reaching the slot part 26 by the pane 81 being stopped by the window frame 82 in the position shown in FIG. 1 and by the limits imposed on movement of the link 1 by the shaft 4 which movably secures the link to the supporting door.

In assembling the window lifting mechanism, the guide channel 6 is mounted without the use of tools on the bracket 7 by inserting the channel through the opening 19 as described above. It is assumed that the bracket 9, guide channel 11, and shaft 4 are more readily accessible than the channel 6. The link 2, therefore, is connected first to the link 1 by means of the pivot pin 3, and the guide pins 5,10 are attached to the links. The link 3 thereafter is secured to the stub shaft 9 and the guide channel 11 in the manner illustrated in FIG. 1. The pin 5 then is engaged in the guide channel 6 described above, and the link 1 ultimately is set on the shaft 4, thereby engaging the segment 44 with the pinion 43. The hands of the mechanic need not approach the guide channel 6 during installation of the link 1.

Depending on the configuration of the hollow space available in a vehicle body for installing a window lifting mechanism, the arrangement illustrated in FIG. 1 may be modified in an obvious manner. If the guide pin 10 on the link 2 needs to be installed in a guide channel which is not readily accessible and not visible during installation, the conventional guide channel 11 may be replaced by a guide channel substantially identical with the guide channel 6, and such a guide channel may be mounted in an opening of the sheet metal wall 22 in the same manner as described above with reference to the guide channel 6 and the bracket 7.

It is generally preferred to mount the relatively bulky guide channels 6,11 on the supporting structure of the door and on the window carrier, and to provide the links 1,2 with fixedly fastened guide pins 5,11, but a reversed arrangement is possible and may be more practical in some instances. Mounting the guide channels 6,11 on the links 1,2 for cooperation with guide pins 5,10 fixedly fastened on the window carrier 8 and the door wall 20 is specifically contemplated. Other permutations and variations of the illustrated window lifting arrangement of the invention will readily suggest themselves to those skilled in the art.

It should be understood therefore, that the foregoing disclosure relates only to a preferred embodiment, and that it is intended to cover all changes and modifications of the example of the invention herein chosen for the purpose of the disclosure which do not constitute departures from the spirit and scope of the invention set forth in the appended claims.

What is claimed is:

1. In a window lifting arrangement including a support member, a window carrier member mounted on said support member for movement in a vertically extending path, stop means on said support member for limiting said movement, drive means on said support member, and linkage means drivingly connecting said drive means to said carrier member, the linkage means including a link member, first securing means movably securing said link member to said carrier member, and second securing means securing said link member to said support member, the improvement in one of said securing means which comprises:

(a) a forked guide channel fixedly mounted on one of the two members secured to each other by said one securing means,
  (1) said channel including two branch portions elongated in a common direction and a bight portion connecting respective, longitudinally terminal parts of said branch portions,
  (2) said branch portions transversely bounding an elongated guide slot therebetween, and said bight portion bounding said slot in one longitudinal direction,
  (3) said slot being approximately keyhole-shaped and having an enlarged, longitudinally terminal first part, and an elongated second part narrower than said first part,
  (4) said branch portions being formed with respective longitudinal grooves open in a direction away from said slot,
  (5) said one member having two edge portions received in said grooves respectively and thereby fastening said channel to said one member; and (b) a guide pin fixedly mounted on the other secured member,
  (1) said pin having a shank portion received in said slot for longitudinal movement and two enlarged head portions outside said slot on respective ends of said shank portion,
  (2) the width of said first part of the slot being sufficient to pass one of said head portions,
  (3) the width of said second part of the slot being smaller than the corresponding dimension of each of said head portions for securing said pin against transverse movement out of said second part.

2. In an arrangement as set forth in claim 1, said first part of said slot being contiguously adjacent said bight portion, and said second part extending from said part in a direction away from said bight portion and being open in said direction.

3. In an arrangement as set forth in claim 1, said branch portions having respective beveled faces bounding said first part of said slot adjacent said second part.

4. In an arrangement as set forth in claim 1, said stop means including means for preventing movement of said guide pin from said second part of said slot into said first part when said link member is secured to said carrier member.

5. In an arrangement as set forth in claim 4, said other secured member being said link member.

6. In an arrangement as set forth in claim 5, said one member being said carrier member.

7. In an arrangement as set forth in claim 1, said one member being said carrier member.

8. In an arrangement as set forth in claim 7, said carrier member being formed with an opening adjacent said edge portions, said channel being dimensioned to pass longitudinally through said opening.

* * * * *